US005153947A

United States Patent [19]

Markles

[11] Patent Number: 5,153,947

[45] Date of Patent: Oct. 13, 1992

[54] URINAL FOR ATTACHMENT TO A TOILET

[76] Inventor: Elmer C. Markles, 1119 Aleppo Ct., Hemet, Calif. 92343

[21] Appl. No.: 744,396

[22] Filed: Aug. 13, 1991

[51] Int. Cl.[5] ..... E03D 13/00

[52] U.S. Cl. ..... 4/342; 4/252.1; 285/56

[58] Field of Search ..... 4/252.1, 262, 144.1, 4/144.2, 144.3, 144.4, 301, 307, 309, 311, 340, 341, 275, DIG. 13, DIG. 16; 285/56, 57, 58, 59, 60; 411/395, 400

[56] References Cited

U.S. PATENT DOCUMENTS

| | | | |
|---|---|---|---|
| 1,186,345 | 6/1916 | Sleight | 4/309 |
| 3,500,480 | 3/1970 | Michal. Jr. | 4/341 X |
| 4,137,579 | 2/1979 | Soler | 4/311 |
| 4,180,875 | 1/1980 | Wilson | 4/309 |
| 4,270,231 | 6/1981 | Zint | 4/144.4 X |
| 4,282,611 | 8/1981 | O'Day | 4/144.1 |
| 4,490,863 | 1/1985 | Pate | 4/301 |

*Primary Examiner*—Thomas B. Will
*Assistant Examiner*—W. Morris Worth
*Attorney, Agent, or Firm*—Edgar W. Averill, Jr.

[57] ABSTRACT

A urinal assembly for attachment to a toilet of the type which is floor mounted over a drain, including a toilet-mounting flange. The urinal has urinal bowl supported adajcent the toilet and the outlet of the bowl connects to a drainline fitting which has a vertical portion which is threaded and used to hold the toilet base, and a horizontal portion which extends under the base of the toilet over the outlet drain. The drainline of the urinal bowl is connected to the vertical portion of the drain fitting. Preferably the urinal bowl is flushed and rinsed with a line which is connected to the toilet tank so that it is periodically rinsed. Also preferably, the urinal bowl swivels downwardly to provide height adjustment.

8 Claims, 4 Drawing Sheets

URINAL FOR ATTACHMENT TO A TOILET

BACKGROUND OF THE DISCLOSURE

The field of the invention is plumbing fixtures, and the invention relates more particularly to a urinal attachment for a conventional household toilet which attachment can be added as an aftermarket unit.

With increasing need for water conservation, it is beneficial to provide a system which reduces the number of times a toilet is flushed. The system should preferably bypass the toilet bowl and yet be periodically rinsed.

Various attempts have been made to provide urinal attachments for conventional toilets, and these are shown in the following U.S. Pat. Nos.: 3,500,480; 3,822,419; 4,137,579; 4,180,875; 4,282,611; 4,549,321; and 4,750,219. Most of these units drain into the toilet bowl, and the remaining units require a uniquely fashioned or modified toilet bowl and cannot be readily attached to an existing unit.

SUMMARY OF THE INVENTION

It is an object of the present invention to provide an aftermarket urinal device which can be attached to a toilet and which will drain directly into the toilet drain.

The present invention is for a urinal assembly for attachment to a toilet of the type which is floor mounted over a drain, including a toilet-mounting flange. The toilet rests on the floor by way of downwardly-depending wall and also has a generally horizontal step which supports a pair of mounting nuts which are tied into the toilet-mounting flange by a pair of mounting bolts. A urinal bowl is supported adjacent the toilet, and the bowl includes an outlet drain to which a drainline is connected. The drainline in turn is attached to a toilet base drain fitting, comprising an el, having a vertical portion connected at an intersection to a horizontal portion, and an enlarged head is affixed below the intersection for attachment to the toilet-mounting flange. The vertical portion has external threads to which a mounting nut is affixed, and the horizontal portion includes a downwardly directed opening over the toilet drain. Preferably, the urinal bowl includes a bowl-rinsing line affixed to the conventional bowl flushing and filling assembly so that whenever the toilet is flushed, the urinal bowl is rinsed. Preferably, the urinal bowl assembly is held to the toilet by way of the toilet seat mounting bolts, which hold a generally horizontal support arm, which is affixed to a vertical support arm, preferably in a manner which permits the vertical arm to swivel.

DESCRIPTION OF THE PREFERRED EMBODIMENTS

Figure 1:
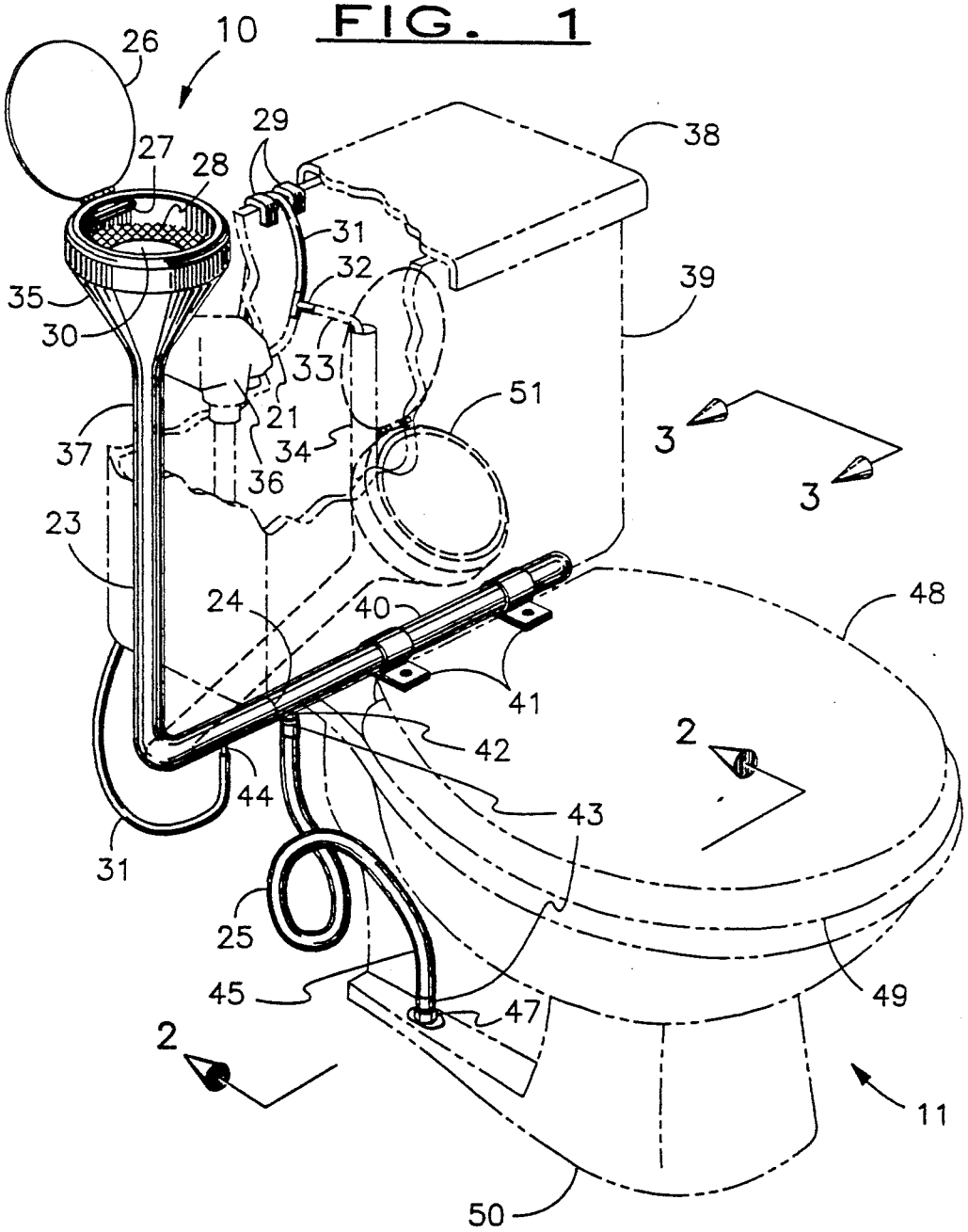
FIG. 1 is a perspective view of the urinal assembly for attachment to a toilet shown in phantom view.

A toilet 11 is shown in perspective view in FIG. 1 and a urinal assembly 10 is affixed thereto by a pair of reversible clamps 41 as described in more detail below. The urinal assembly has funnel-shaped urinal bowl 35 which supports a screen which, in turn, supports a deodorant cake 30. Urinal bowl 35 is supported by a vertical outlet drain 37 which is hollow and is connected to a urinal drain line 45. Vertical support arm 23 is integral with horizontal support arm 40 which includes a swivel connection 24 as shown best in FIG. 5 of the drawings. Horizontal support arm 40 preferably has a blind plug just past the point of connection of the drain line 45.

The manner in which the urinal drain line 45 connects to the toilet drain pipe 56 is an essential feature of the present invention. This is carried out by the unique fitting shown in perspective view in FIG. 4 and in side view, partially cut away, in FIG. 2. This fitting is basically a hollow el which has a vertical portion 15, a horizontal portion 16, which portions are connected at an intersection 17. An enlarged head 18 is formed integrally with the fitting and is supported in a manner analogous to a conventional toilet mounting bolt 57, and the enlarged head 18 fits below the toilet mounting flange 12. The toilet is then secured to the floor 55 by toilet hold-down nuts 47. Such nuts are typically covered by a bolt cover 58 as shown in FIG. 2.

Figure 2:
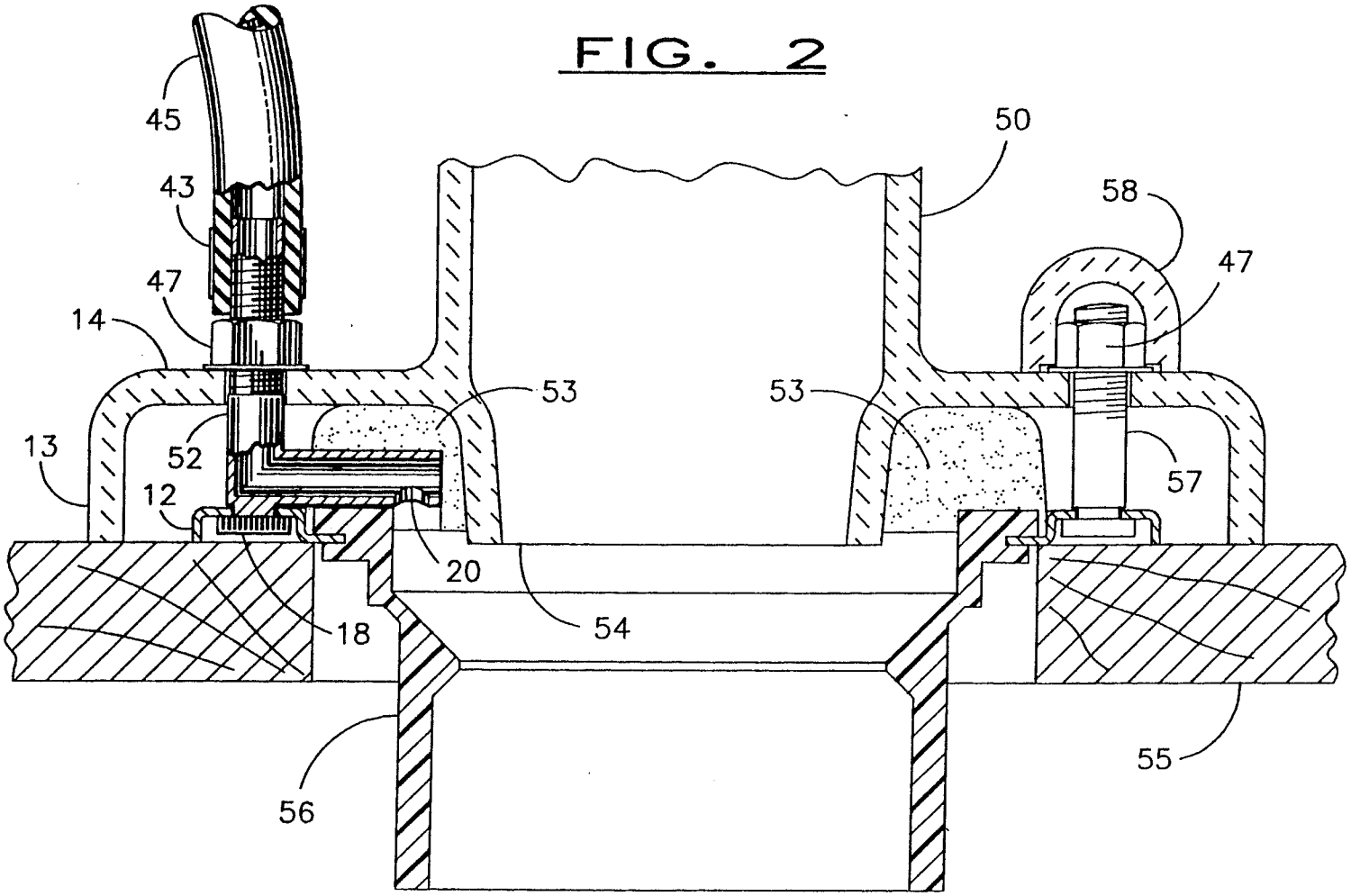
FIG. 2 is an enlarged cross-sectional view of the base of the toilet and of the toilet base drain fitting.
Figure 3:
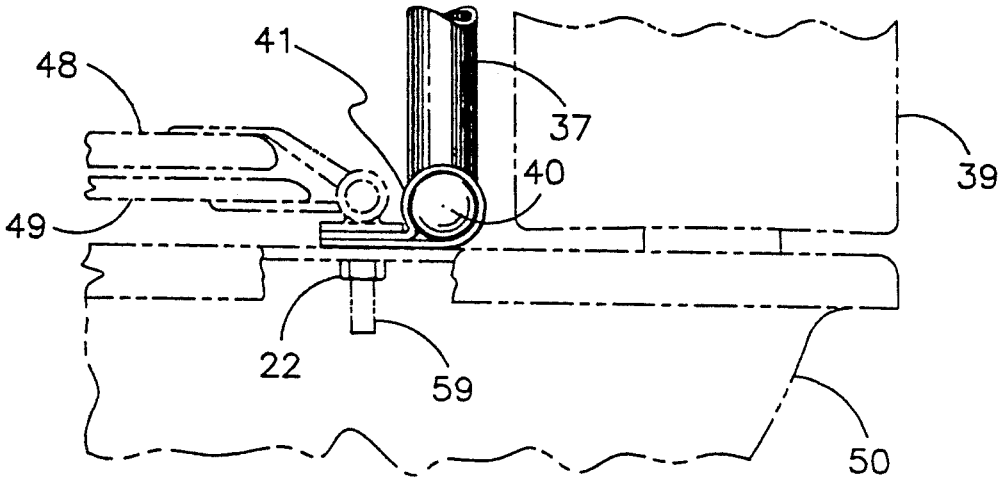
FIG. 3 is an enlarged side view of the horizontal arm and toilet seat-holding assembly of the assembly of FIG. 1.
Figure 4:
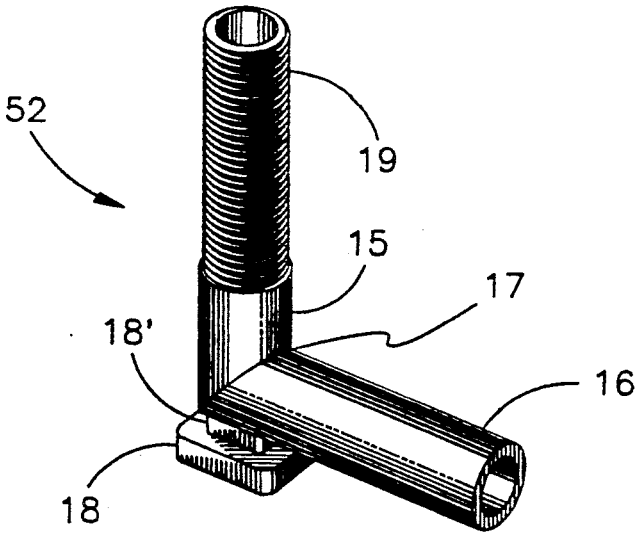
FIG. 4 is an enlarged perspective view of the toilet base drain fitting of FIG. 2.

The fitting of FIG. 4 also has a downwardly directed opening 20 as shown in FIG. 2. In the mounting of the unit in a conventional toilet, the conventional toilet is removed by removing toilet hold-down nuts 47. One of the hold-down bolts 57 is removed, and the fitting 52 is inserted in the place of the conventional hold-down bolt. The enlarged head 18 fits within the conventional slot in the toilet mounting flange 12 and the shank 18' of the enlarged head 18 is also square and holds the fitting 52 in a fixed position. The downwardly directed opening 20 is above the opening of the drainpipe 56 so that it drains freely into the drain pipe. A conventional wax ring is then placed over the horizontal portion 16 of fitting 52 and is otherwise placed in the usual position for such wax rings, after which the toilet bowl horn 54 is inserted therethrough, and the generally horizontal step 14 passes over the threaded portion 19 of fitting 52 as well as the threaded portion of the toilet hold-down bolt 57. The nuts 47 are then tightened in a conventional manner, and the toilet is then secured in place.

Figure 5:
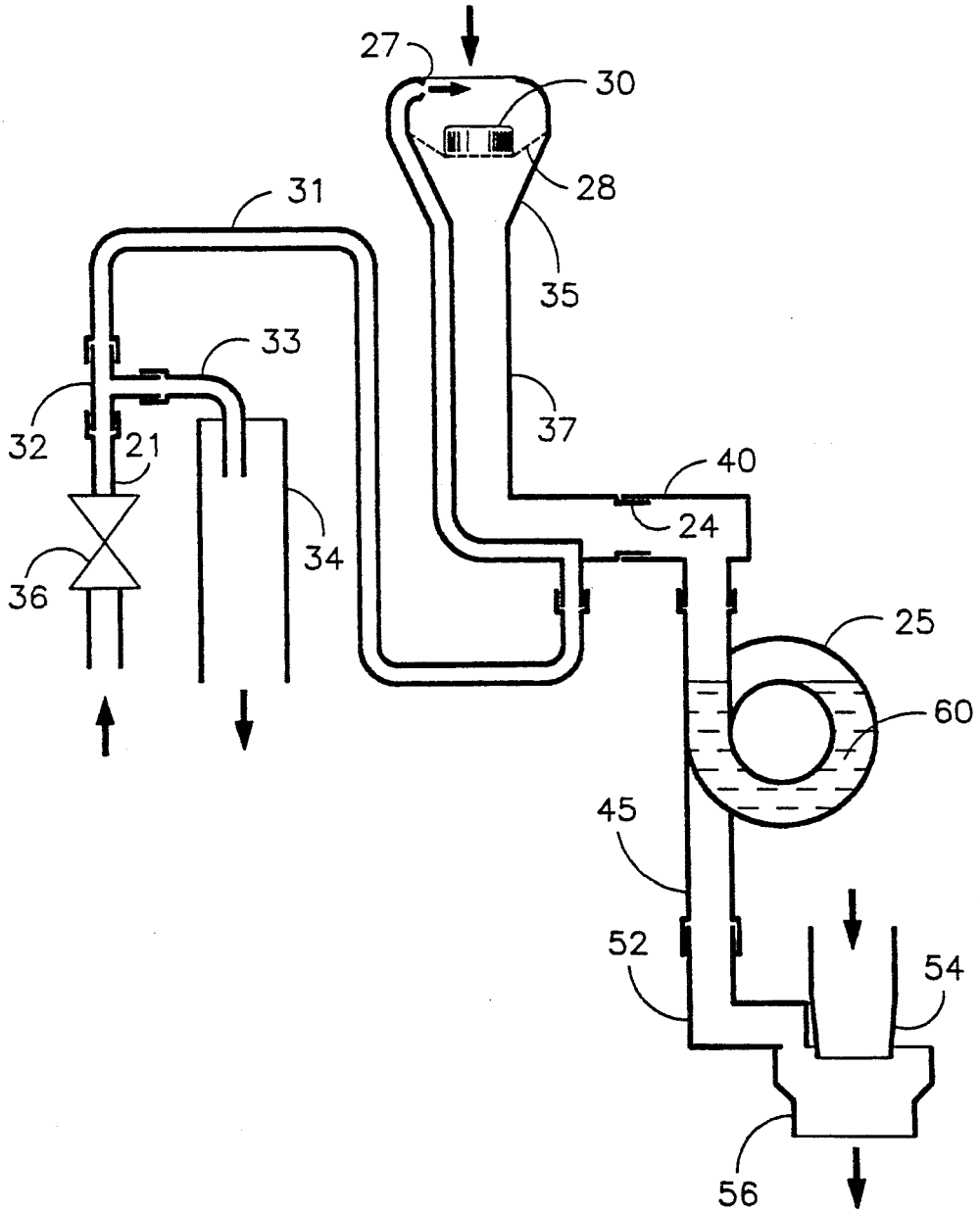
FIG. 5 is a diagrammatic view of the urinal assembly of FIG. 1.

Next, the urinal drain line 45 is clamped by clamp 43 to the threaded portion 19 of fitting 52, and a loop 25 is formed in drainline 45 to retain a water seal as shown best in FIG. 5 and indicated by reference character 60. Preferably, the horizontal portion 40 is held to the toilet by the toilet seat bolts 59 and nuts 22 by a pair of reversible clamps 41. This permits the horizontal tube to be mounted in either direction so that the vertical support arm can either be on the left side or the right side of the toilet tank 39. Of course, fitting 52 can be placed on either side of the toilet, depending on the desired mounting position.

In use, the urinal can be swiveled down to the position shown at reference character 51 by swivel connection 24 and then returned to a vertical position after use. Also, the funnel cover 26 may be closed and, when combined with the deodorant cake 30, which is held on screen 28, provides sufficient odor protection without the need for flushing the toilet after each use of the urinal. The normal flushing of the toilet provides a rinsing action as described below.

Toilet 11 has conventional toilet tank inlet valve 36 which contains a bowl rinsing line 21 which is normally directed into a toilet tank overflow tube 34. When assembling the present unit, however, this line is cut and a tee 32 is placed in the line and the toilet tank refill tube 33 is fed into the toilet tank overflow tube 34 and a bowl rinsing line 31 is connected to the other and straight end of the tee. It has been found important to connect the bowl rinsing line 31 to the straight portion of the tee to which the bowl rinsing line is also connected. This provides sufficient water flow to rinse nozzles 27 positioned within the urinal bowl 35. A spacer 29 permits the toilet tank cover 38 to be replaced without pinching the bowl rinsing line 31.

Preferably, the outlet drain 37 and the horizontal support arm 40 are fabricated from a rigid plastic such as polyvinylchloride. The outlet line 45 is connected to the hollow portion of horizontal support arm 40 by way of a drain nipple 42 and a clamp 43. The bowl rinsing line 31 is preferably contained within vertical support arm 23 by way of a urinal supply nipple 44 which passes into an internal passageway which feeds rinse nozzle 27 as indicated diagrammatically in FIG. 5.

After the unit has been installed, the toilet seat cover 48 operates in the same manner as does of course the toilet seat 49. The toilet bowl 50 does not have to be modified in any way, and the unit is compact and completely out of the way when not being used.

By use of the unit of the present invention, the amount of water required is substantially decreased, and the unit also provides a neat and sanitary system.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A urinal assembly for attachment to a toilet of the type which is floor mounted over a drain including a toilet mounting flange and which toilet rests on the floor by way of a downwardly depending wall with a generally horizontal step which supports a pair of mounting nuts, said urinal assembly comprising:

a urinal bowl supported adjacent said toilet, said urinal bowl including an outlet drain;

a drain line connected to said urinal outlet drain and leading downwardly to a toilet base drain fitting; wherein rail toilet base drain fitting comprises an el having a vertical portion connected at an intersection to a horizontal portion and having an enlarged head for attachment to said toilet mounting flange below said intersection, in a manner analogous to a conventional toilet mounting bolt said vertical portion being connected to said drain line and having external threads to which a mounting nut is affixed for securing the toilet to the floor and said horizontal portion including a downwardly directed opening over said toilet drain.

2. The urinal assembly for attachment to a toilet of claim 1 wherein said toilet includes a bowl flushing and filling assembly including a bowl rinsing line and wherein said urinal assembly further includes a rinse nozzle and a urinal bowl flushing line, fluidly connected at one end to said rinse nozzle and at another end to said bowl rinsing line of said bowl flushing and filling assembly.

3. The urinal assembly for attachment to a toilet of claim 1 wherein said toilet has a toilet seat held to the toilet by a pair of bolts and nuts and wherein said urinal assembly includes means for holding said urinal assembly to said toilet by said toilet seat bolts and nuts.

4. The urinal assembly for attachment to a toilet of claim 3 wherein said urinal outlet drain, has a generally horizontal support arm and a generally vertical support arm and said mean for holding said urinal assembly comprises has a pair of reversible clamps on said generally horizontal support arm so that the urinal assembly can be mounted on either side of the toilet.

5. The urinal assembly for attachment to a toilet of claim 3 wherein said urinal outlet drain has a generally horizontal support arm and a generally vertical support arm and said generally horizontal support arm has a swivel connection therein.

6. The urinal assembly for attachment to a toilet of claim 1 wherein said urinal bowl has a hinged cover thereon.

7. The urinal assembly for attachment to a toilet of claim 1 wherein said drain line has a loop therein to retain a quantity of water to prevent gas from escaping from the toilet drain up through the urinal drain line.

8. A urinal assembly for attachment to a toilet of the type which is floor mounted over a drain including a toilet mounting flange and which toilet rests on the floor by way of a downwardly depending wall with a generally horizontal step which supports a pair of mounting nuts said urinal assembly comprising:

a urinal bowl means for movably supporting said urinal bowl adjacent said toilet, said urinal bowl including a rinse nozzle and an outlet drain;

a drain line connected to said urinal outlet drain and leading downwardly to a toilet base drain fitting; and wherein said toilet includes a bowl flushing and filling assembly including a bowl rinsing line and wherein said urinal assembly further includes a urinal bowl flushing line fluidly connected at one end to said rinse nozzle and at another end to said bowl rinsing line of said bowl flushing and filling assembly.

* * * * *